US006851129B2

(12) United States Patent
Gafforio et al.

(10) Patent No.: US 6,851,129 B2
(45) Date of Patent: Feb. 8, 2005

(54) DEVICE FOR MOUNTING THE VISOR ONTO THE CAP OF A HELMET

(75) Inventors: Loca Gafforio, Comun Nuovo (IT); Alberto Salvetti, Bergamo (IT); Gabriele Tomasoni, Barlano (IT)

(73) Assignee: Opticos S.r.l., Brembate di Sopra (IT)

( * ) Notice: Subject to any disclaimer, the term of this patent is extended or adjusted under 35 U.S.C. 154(b) by 0 days.

(21) Appl. No.: 10/660,664

(22) Filed: Sep. 12, 2003

(65) Prior Publication Data

US 2004/0049830 A1 Mar. 18, 2004

(30) Foreign Application Priority Data

Sep. 12, 2002 (EP) ..... 02425557

(51) Int. Cl.[7] ..... A42B 1/08
(52) U.S. Cl. ..... 2/424
(58) Field of Search ..... 2/425, 424, 410, 2/10

(56) References Cited

U.S. PATENT DOCUMENTS

| | | | | |
|---|---|---|---|---|
| 5,062,162 A | * | 11/1991 | Kamata | 2/424 |
| 6,654,969 B2 | * | 12/2003 | Taniuchi | 2/424 |
| 2003/0088907 A1 | * | 5/2003 | Gafforio et al. | 2/424 |

FOREIGN PATENT DOCUMENTS

| | | | | |
|---|---|---|---|---|
| DE | 296 13 254 U | | 9/1996 | |
| EP | 0 482 731 A | | 4/1992 | |
| EP | 0 628 261 A | | 12/1994 | |
| EP | 629357 A2 | * | 12/1994 | A42B/3/22 |
| EP | 1 057 418 A | | 12/2000 | |
| FR | 2 785 505 | | 5/2000 | |

* cited by examiner

*Primary Examiner*—Rodney M. Lindsey
(74) *Attorney, Agent, or Firm*—Nixon & Vanderhye P.C.

(57) ABSTRACT

Mechanism to removably anchor a side area (3) of a visor (20) to the cap (2) of a helmet so that the visor rotates in relation to the eyeport opening (12) of the helmet, of the type comprising:

a base structure (1), anchored to the cap, and provided with at least one circular guide groove (4*a*) substantially orthogonal to the axis of rotation (A—A) of the visor and which has at least one widened portion defining an opening (5*a*);

at least one hooking element (22*a*) integral with said side area of the visor and suitable to engage slidingly inside the circular groove, the hooking element being held in place by the circular guide groove except when corresponding to the opening defined by the widened portion;

The mechanism also comprises at least one locking tab (6) substantially positioned corresponding to the widened portion and made to translate, along an axis coinciding with or substantially parallel to the axis of rotation (A—A) of the visor, between a position in which said locking tab intercepts the widened portion, reducing the opening (5*a*), and a position in which the locking tab is disengaged from the widened portion and frees the opening (5*a*).

19 Claims, 4 Drawing Sheets

2
3
4a
4b
5a
5b
6
7
8
9
10
11a
11b
12
21

DEVICE FOR MOUNTING THE VISOR ONTO THE CAP OF A HELMET

The present invention relates to a mechanism for rotatingly mounting a side area of a visor on the cap of a helmet, in such a way that, to allow it to be replaced, the visor is removable in relation to the cap.

Mounting a visor rotatingly on the cap to allow the eyeport opening of the helmet to be opened and closed has been obtained for a long time by a pair of mechanisms which, positioned at the sides of the eyeport opening, removably anchor the side areas of the visor to the cap. Each mechanism allows the user, normally with the use of suitable tools, to release (unhook) the visor from the helmet, replace it and then mechanically fix a new visor on the two mechanisms.

Particularly in the motorcycle sector, the need for removability of the visor in relation to the cap, due to unavoidable deterioration of the visor during use, combined with the need to obtain mechanical structures that are simple to produce and assemble, have driven operators in the sector to devise mechanisms to anchor the visor to the helmet which are targeted at being structurally simplified and easy to operate.

Prior art mechanisms to removably anchor a visor to the cap of a helmet comprise a base structure designed to be fixed to the cap, for example by bolting, and a pin with a corresponding hole, integral with the base structure and the visor respectively, or vice versa, which are coupled to rotatingly anchor the visor to the cap. A screw, or other threaded fixing means, of appropriate size and shape and positioned corresponding to the pin, has the purpose of preventing any movement of the visor along its axis of rotation in relation to the base structure of the mechanism. To remove and mount the visor in relation to the helmet it is therefore necessary to unscrew and tighten the fixing screw using a specific tool and therefore to couple and uncouple the hole and the pin.

Although this operation may be performed by any user, it is not always easy to execute and also causes progressive deterioration of the thread of the fixing means. Moreover, it is an operation which normally requires a certain amount of physical exertion by the user, the use of appropriate tools and a considerable amount of time.

To make up for these limits, patent application EP-A-0.482.731, in the name of SHOEI, teaches the realization of a mechanism to removably mount the visor of a helmet to the cap comprising a base structure, fixed to the cap by screws, on which a cylindrical seat is produced provided with a circular guide and coupling projections, or hooks, integral with the visor. The coupling projections of the visor, during assembly of the helmet or replacement of the visor, are rotatingly anchored in the circular guide, so that the visor may rotate, but not translate, around the axis of the cylindrical seat.

To allow the hooks to be inserted and removed from the circular guide, in the SHOEI mechanism the circular guide has an aperture and a corresponding movable locking tab provided at the aperture. The locking tab is made to translate along a direction substantially orthogonal to the axis of rotation of the visor from an engaged position to a disengaged position with the aperture of the circular guide, and is held in this engaged position by a spring. Moreover, the locking tab is operatively connected to a tie-rod which is only accessible if the visor is raised completely in relation to the eyeport opening of the helmet.

Operation of the tie-rod causes the locking tab to translate and disengage from the aperture of the cylindrical guide, so that hooks integral with the visor can be anchored to or released from the guide through this aperture. Although this SHOEI mechanism allows the visor to be removed from the cap without excessive difficulty, it is nonetheless cumbersome owing to the considerable dimensions of the base support, In fact, to guarantee reliable operation of the mechanism, this must be designed to contain the tie-rod of the locking tab and guide its complete travel on a plane orthogonal to the axis of rotation of the visor, with consequent increase in its dimensions along this plane.

Moreover, the SHOEI mechanism could bring about accidental movements of the locking tab, and consequently possible accidental release of the visor, in the case in which with the visor raised the user was to unwittingly move the visor in the direction of translation of the locking tab.

A mechanism similar to the one in application EP-A-0.482.731 in which in place of the tie-rod, a rocking lever is provided to operate locking tabs engaged in corresponding apertures of circular guides, is described in the European patent application EP-A-0.629.357 (SHOEI). Also in this mechanism, the locking tabs, normally held closed elastically, are made to move to the position disengaged from the apertures on a plane substantially orthogonal to the axis of rotation of the visor and the lever can only be operated when the visor is completely raised.

Although accidental release of the visor is almost impossible in this latter mechanism, it does not solve the problem of overall dimensions, which are even greater.

The presence of the rocking lever and of locking tabs shaped according to curved lines also increases the complexity of the mechanism and thus makes it somewhat difficult to produce.

The object of the present invention is to produce a mechanism to removably anchor a side area of a visor to the cap of a helmet which does not have the afore-mentioned drawbacks of prior art.

It is therefore the object of the present invention to provide a mechanism to removably anchor a side area of a visor to the cap of a helmet which has limited dimensions, is structurally simple and reliable and simultaneously capable of preventing any accidental release of the visor.

Another object of the present invention is to provide a mechanism with a reduced number of components, and thus easy to assemble on the cap of a helmet, which is also extremely simple to operate and allows the visor to be replaced without the use of any tools, while remaining totally reliable to use.

These and other objects are attained with the mechanism to removably anchor a side area of a visor to the cap of a helmet, so that the visor rotates in relation to the eyeport opening of the helmet, as claimed in the first independent claim and the subsequent dependent claims.

The mechanism to removably anchor a side area of a visor to the cap of a helmet so that the visor rotates in relation to the eyeport opening of the helmet, according to the present invention, comprises:

- a base structure, anchored to the cap, and provided with at least one circular guide groove substantially orthogonal to the axis of rotation of the visor and which has at least one widened portion defining an opening; and
- at least one hooking element (or "hook") integral with said side area of the visor and suitable to engage slidingly inside the aforesaid circular groove. The hooking element, after being inserted, is held in place in the circular guide groove except when corresponding to the opening defined by the widened portion of the guide.

The mechanism also comprises at least one locking tab substantially positioned corresponding to the widened portion of the guide and made to translate, along an axis coinciding with or substantially parallel to the axis of rotation of the visor, between a position in which said locking tab intercepts the widened portion, reducing the opening, and a position in which the locking tab is disengaged from the widened portion, freeing the opening.

Movement of the locking tab along an axis parallel to or coinciding with the axis of rotation of the visor makes it possible to limit the transverse dimensions of the base support, without substantially influencing the dimensions along said axis of rotation.

Moreover, this operation of the locking tab makes it substantially impossible for the locking tab to be accidentally moved owing to the inexperience of the user. In fact, any accidental movements of the visor along this axis do not necessarily imply movement of the locking tab, which does not perform the function of axially holding the hooking element of the visor in place, having the sole purpose of blocking the opening through which the hooking element of the visor may travel.

According to a specific aspect of the present invention, the mechanism has a cylindrical seat, produced in said base structure, mounted elastically inside which is a button integral with the aforesaid locking tab that engages with the widened portion of the guide groove. This button is anchored to translate along the axis of its cylindrical seat, advantageously parallel to or coinciding with the axis of rotation of the visor, to allow translation of the locking tab. Elastic mounting of the button is also carried on by a helical spring which pushes the button so that the locking tab is disposed in the position in which it intercepts the opening for the hooking element of the visor.

The presence of a button connected to the aforesaid locking tab makes the mechanism, as will be further clarified hereafter, structurally simple and easy to operate, although preventing accidental release of the visor.

According to another aspect of the present invention, the elastic button also has an upper cylindrical projection on which the side area of the visor pivots thanks to a corresponding hole produced in this side area. Moreover, the opening defined by the widened portion of the guide groove is preferably set apart from the axis of this upper projection of the button to allow the hooking element to be inserted in the guide and simultaneously prevent this upper projection from being coupled with the hole on the side area of the visor.

The object of this solution is to oblige the user to impose two incident forces, on the button and visor respectively, in order to unhook the latter from the cap. In fact, as shall be seen, to free the opening and release the hole of the visor from the projection on this button, the button must be pushed along its sliding axis and to allow the hooking element to be moved corresponding to the opening, the visor must be made to translate substantially orthogonal to this sliding axis of the button.

In a particularly advantageous embodiment of the present invention, moreover, the widened portion of the guide groove is disposed so that the hooking element integral with the visor is positioned corresponding to the opening defined by the widened portion only when the visor is in its fully open position in relation to the eyeport opening of the helmet.

This prevents the visor from being unhooked in positions different from the one in which it is totally raised, which is usually only when the motorcycle is not moving.

Some preferred embodiments of the present invention shall now be described, purely as a non-limiting example, with the aid of the attached figures, in which.

Figure 1:
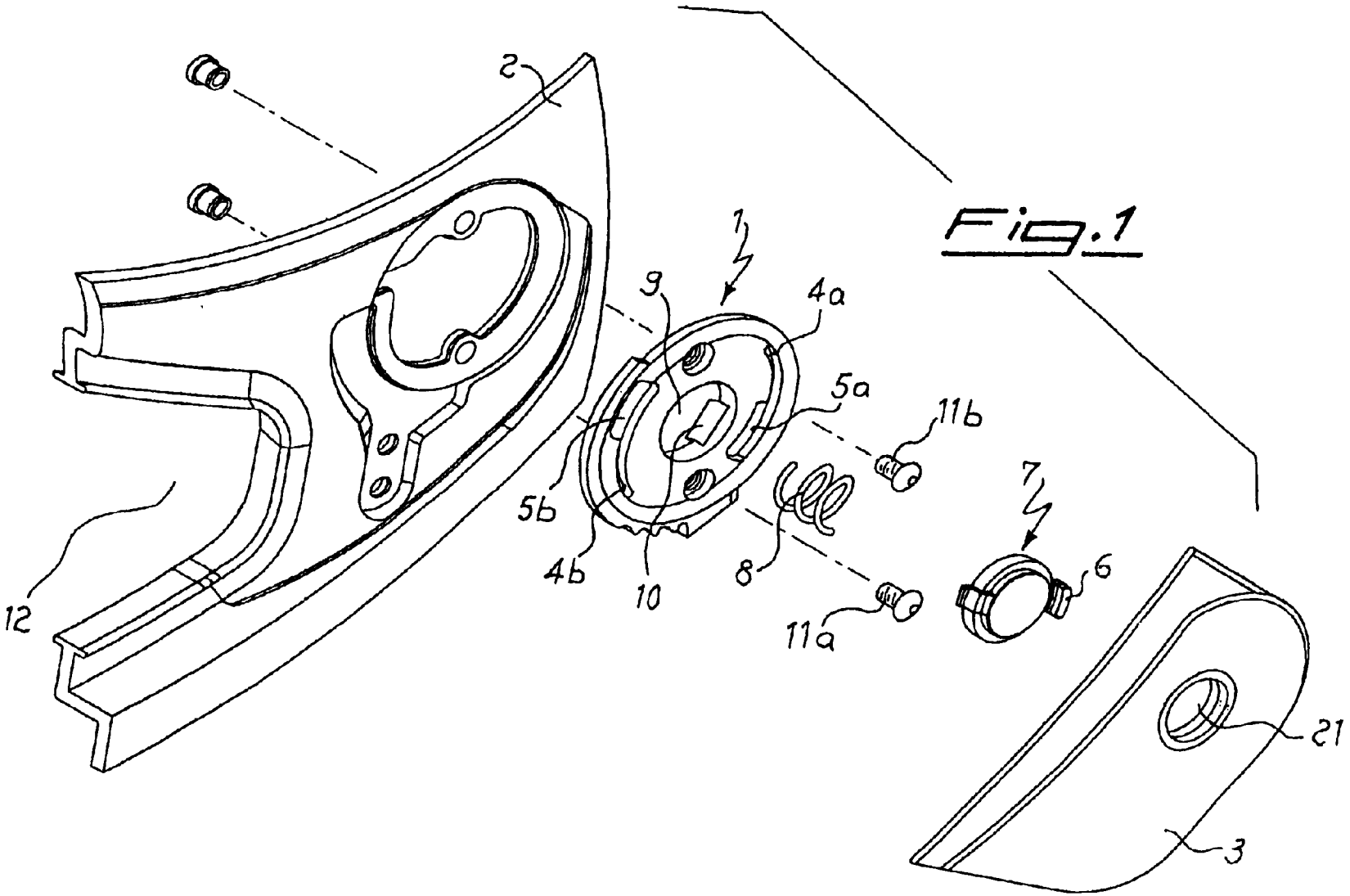
FIG. 1 is an exploded view of a mechanism for removably anchoring a side area of a visor to the cap of a helmet, so that the visor rotates in relation to the eyeport opening of the helmet, according to a particular aspect of the present invention.
Figure 2:
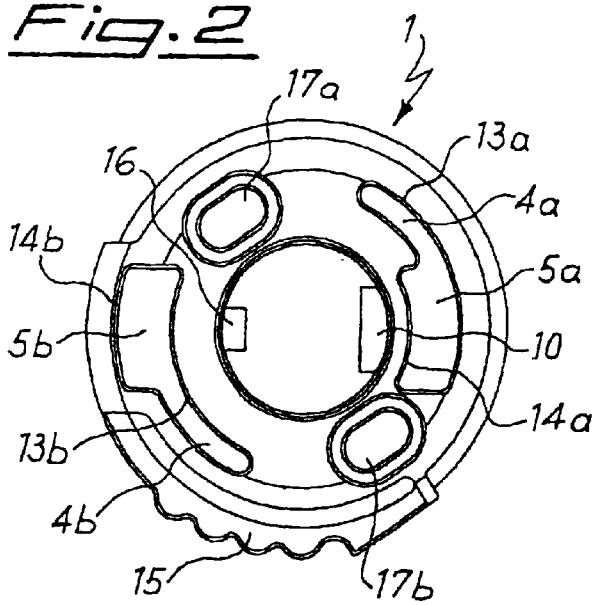
FIG. 2 is a plan view of the base support of the mechanism in FIG. 1.
Figure 3:
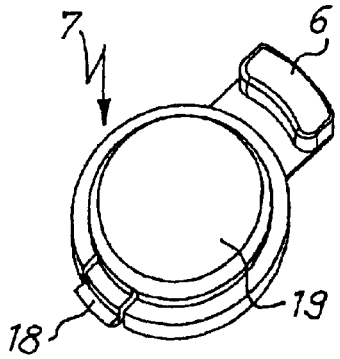
FIG. 3 is a perspective view of the release button provided in the mechanism in FIG. 1.
Figure 4A:
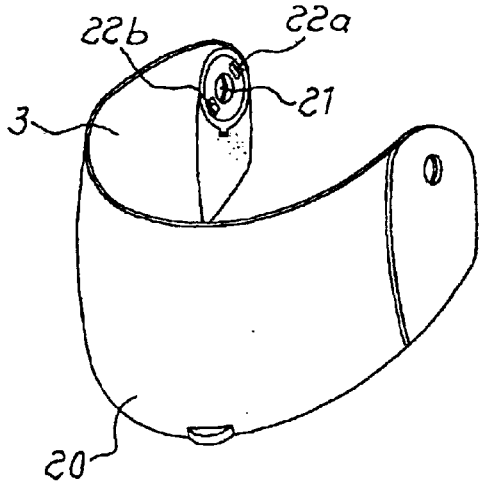
Figure 4B:
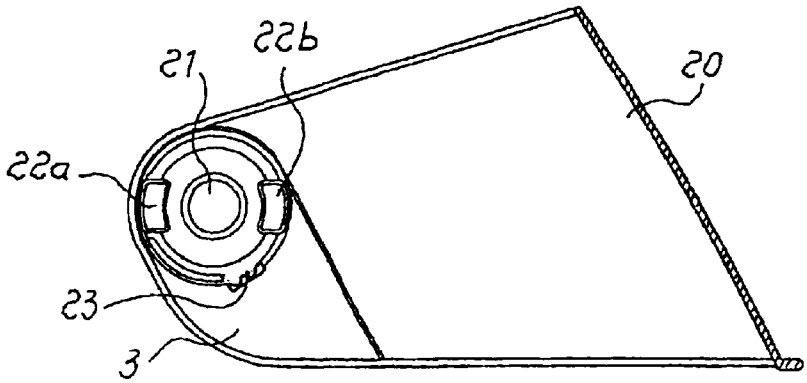
Figure 5:
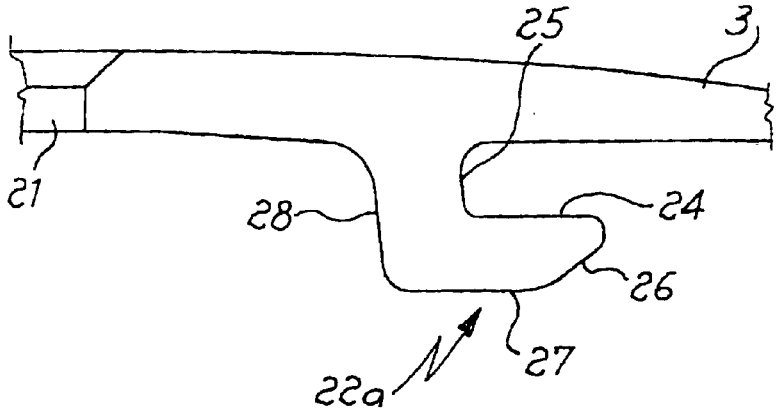
Figure 7:
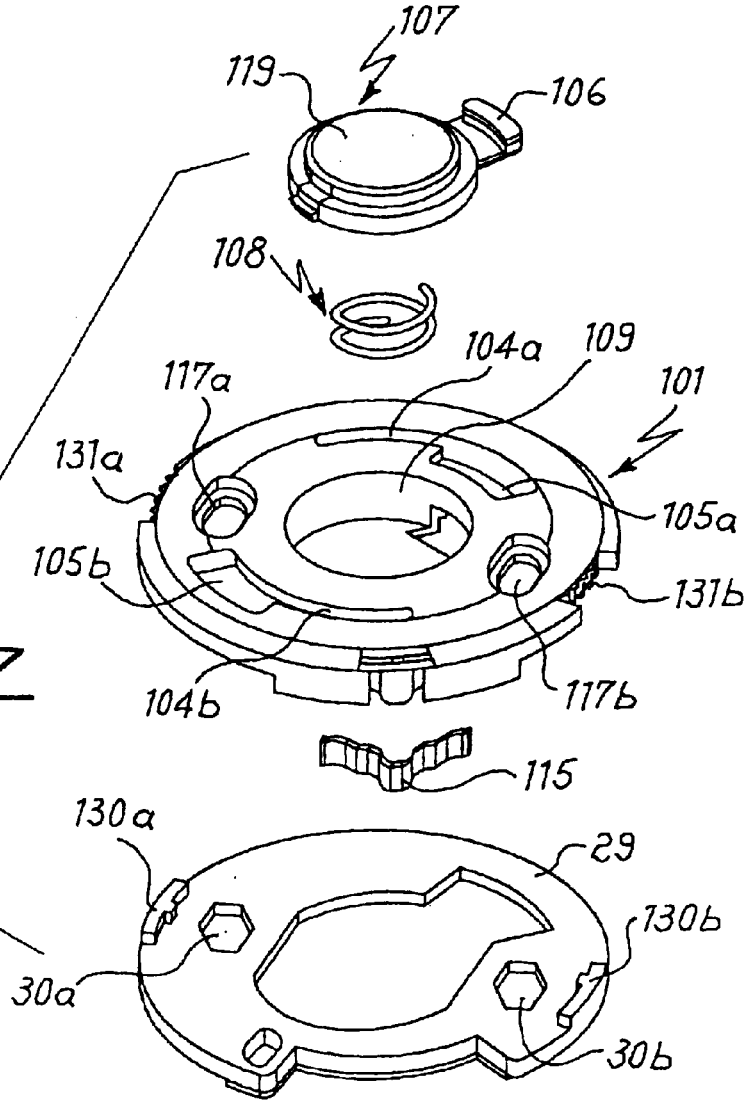
Figure 6A:
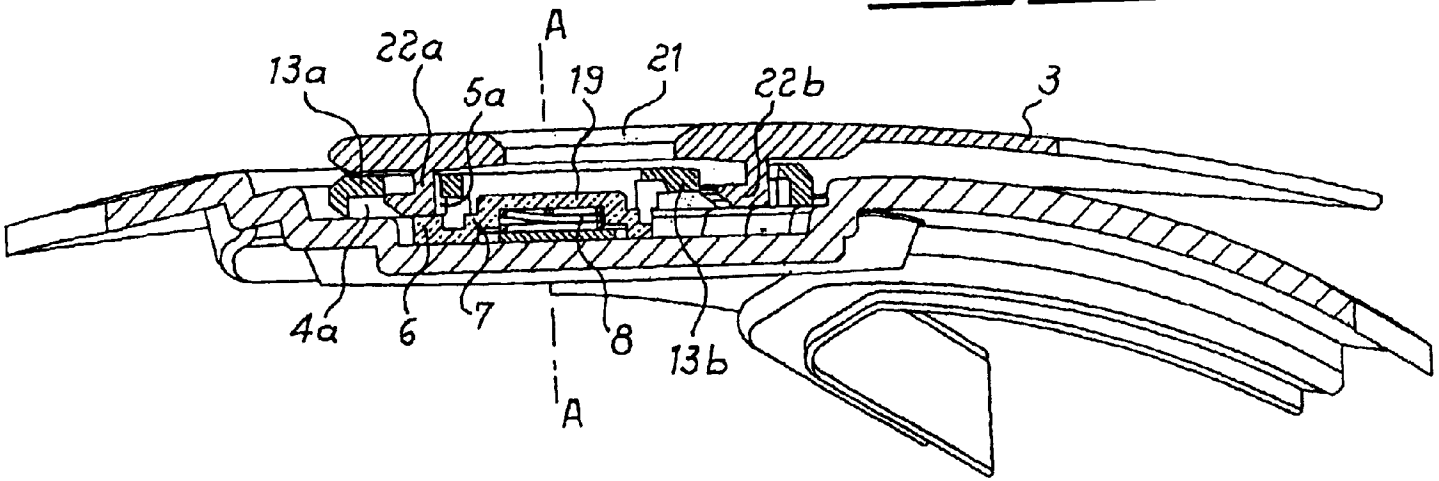
Figure 6B:
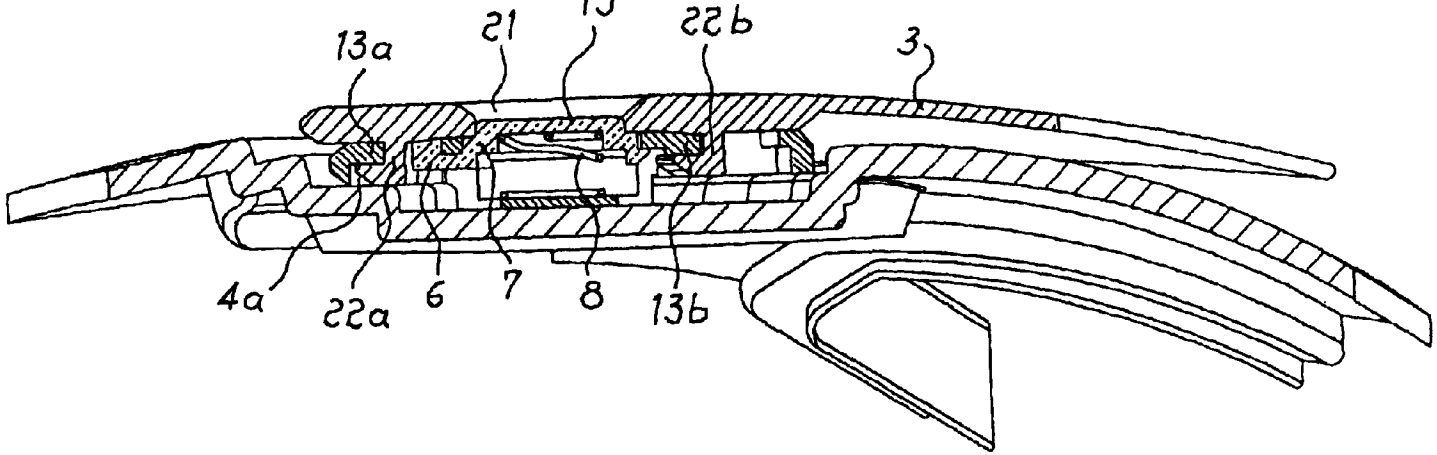

FIGS. 4*a* and 4*b* are respectively a perspective view and a partially sectioned side view of a visor designed to be mounted on the mechanism in FIG. 1;

FIG. 5 is a detailed side view of a hooking element, integral with the visor, according to a particular aspect of the present invention;

FIGS. 6*a* and 6*b* are sectional views of the mechanism in FIG. 1 respectively during coupling with the visor and upon attaining this coupling; and FIG. 7 is an exploded view of a mechanism for removably anchoring a side area of a visor to the cap of a helmet so that the visor rotates in relation to the eyeport opening of the helmet, in a different embodiment of the present invention.

With reference to FIG. 1 and FIGS. 4*a*, 4*b*, the mechanism to removably anchor a side area 3 of a visor 20 to the cap 2 of a helmet so that the visor 20 rotates in relation to the eyeport opening 12 of the helmet, according to the present invention, comprises a base structure 1 anchored to the cap 2, if necessary by means of bolts 11*a*, 11*b*, and provided with at least one circular guide groove 4*a* or 4*b* which lies on a surface substantially orthogonal to the axis A—A (FIGS. 6*a*–6*b*) of rotation of the visor 20 and which has at least one widened portion defining an opening 5*a* or 5*b*.

The mechanism also comprises at least one hooking element 22*a* or 22*b*, integral with the side area 3 of the visor 20 which, as shall be shown in greater detail hereafter, is designed to engage slidingly inside the guide groove 4*a* or 4*b*. The groove 4*a* or 4*b* is shaped to axially hold the hooking element 22*a* or 22*b* of the visor 20 in place during its rotation, except when corresponding to the opening 5*a* or 5*b* defined by the aforesaid widened portion.

Also corresponding to the opening 5*a* is a locking tab 6 made to translate, along an axis coinciding with or substantially parallel to the axis A—A of rotation of the visor 20, between a position in which the locking tab 6 intercepts the widened portion reducing the opening 5*a* and a position in which this locking tab 6 is disengaged from the widened portion, thus freeing the opening 5*a*.

Translation of the locking tab 6 along an axis substantially parallel to or coinciding with the axis A—A of rotation of the visor, to block or free the opening 5*a*, makes it possible to reduce the dimensions of the base structure 1 in a direction transverse to said axis A—A and simultaneously, as this translation of the locking tab 6 does not interfere with any axial movements of the visor 20, it helps to prevent accidental release (unhook) of the visor 20 from the structure 1 and therefore from the cap 2.

According to a preferred aspect of the present invention, shown in FIGS. 1 and 4*a*, 4*b*, moreover, the guide groove 4*a* holds the respective hooking element 22*a*, integral with the visor 20, in place, so that the latter can only move along the circular trajectory defined by the groove 4*a*, except when corresponding to the opening 5*a*. In fact, when it is not blocked by the locking tab 6, the hooking element 22*a* may translate in a direction substantially orthogonal to the axis of rotation A—A of the visor 20, and then slide in the opening 5*a* along a direction parallel to the axis A—A, to disengage from the groove 4*a*.

In other words, the function of the locking tab 6 is to reduce the extension of the opening 5*a* in a direction orthogonal to the axis of rotation A—A of the visor 20 and therefore to prevent any accidental translation of the hooking element 22*a* along the direction orthogonal to the axis A—A, otherwise possible in the opening 5*a*. Translation of the locking tab 6 only in a direction parallel to the axis A—A, makes any movements of the hooking element 22*a* transverse to the axis A—A have no effect whatsoever on the locking tab 6. FIGS. 1 to 5 show a preferred embodiment of the mechanism according to the present invention, comprising a base structure 1 anchored to the cap 2 of a helmet in the vicinity of a side end of the eyeport opening 12 of the helmet. The helmet comprises, in the vicinity of the other end of the eyeport opening 12 on the cap 2, a second mechanism specular to the one shown in FIGS. 1–5.

The structure 1 comprises through holes 17*a*, 17*b*, inside which bolts 11*a*, 11*b* are inserted, which, by means of threaded inserts inserted in suitable holes produced on the cap, fix the base structure 1 to the cap 2. The through holes 17*a*, 17*b* may take the shape of elongated slots to allow accurate adjustment of the angular position of the structure 1 in relation to the cap 2 during assembly of the helmet. Although the use of fixing bolts has been shown, any other known means suitable to fix the base structure 1 to the cap 2 may be used without departing from the scope of protection of the present patent right.

Two guide grooves 4*a*, 4*b*, are also produced on the base structure 1 (see detail FIG. 2), each of which comprises a supporting and retaining rim 13*a*, 13*b* on which a respective hooking element (or hook) 22*a*, 22*b*, integral with the visor 20, engages slidingly, and an widened portion 14*a*, 14*b* which defines an opening 5*a*, 5*b* for this respective hooking element 22*a*, 22*b*. The supporting and retaining rim 13*a*, 13*b* is produced as an undercut of the base structure 1 and has a thickness and length, in a direction orthogonal to the axis A—A, sufficient to allow each hooking element 22*a*, 22*b* of the visor 20 to engage and slide along the circular trajectory defined by the groove 4*a*, 4*b*.

The base structure 1 also comprises a cylindrical seat 9 inside which an elastic button 7 is mounted, slidingly along the axis of this cylindrical seat 9. The button 7 is made elastic by the presence of a spring 8, which is preferably of the helical type in metal wire, interposed between the base of the cylindrical seat 9 and the upper internal surface of the button 7.

In the embodiment shown, the circular guide grooves 4*a*, 4*b* are diametrally opposite in relation to the axis of the cylindrical seat 9 and define a circular trajectory with an angle having a width of at least 45°. The presence of two guide grooves 4*a*, 4*b* improves the stability and reliability both of rotation of the visor 20 and its assembly, by means of the hooking elements 22*a*, 22*b*, on the cap 3.

The button 7 is connected to a locking tab 6 which, disposed corresponding to the opening 5*a* of the guide groove 4*a*, may translate, operated by the button 7, along an axis substantially parallel to or coinciding with the axis A—A of rotation of the visor 20 between a position to intercept the opening 5*a* and a position disengaged from this opening. The opening 5*b* of the other guide groove 4*b* is not however occluded by any locking tab and therefore allows free passage of the hooking element 22*b*.

In greater detail, the locking tab 6 (FIG. 3) acts as an appendix of the button 7 and the cylindrical seat 9 is produced so that its axis is substantially parallel to or coinciding with the axis of rotation A—A of the visor, so that translation of the elastic button 7 along the axis of the seat 9 causes identical translation of the locking tab 6 corresponding to the opening 5*a*. In the embodiment shown the locking tab 6 reaches its operating position by being inserted into a window or through hole 10 cut along the side surface of the cylindrical seat 9 corresponding to the opening 5*a*.

The helical spring 8 is also shaped to push the button 7 in a position so that in the absence of other forces on this button 7, the locking tab 6 is engaged with the opening 5*a* of the guide groove 4*a*. In the embodiment shown the spring 8 pushes the button 7 towards the outside of the cap 2 and therefore the locking tab 6 is pushed to occlude the opening 5*a*.

The button 7 also has, in a diametrally opposite position to the locking tab 6, a projection 18, elastically deformable, which engages in a housing 16 cut in the side surface of the cylindrical seat 9 and positioned in the direction of the axis of this seat 9 to allow the button 7 to translate along said axis. The function of the projection 18 is to anchor the button 7, in combination with insertion of the locking tab 6 inside the window 10, to slide only along the axis of the cylindrical seat 9 and to prevent the button 7 from coming out of the cylindrical seat 9 through the effect of the thrust of the spring 8. Moreover, as will be explained hereafter, the projection 18 allows simple assembly of the button in the seat 9.

Furthermore, in the preferred embodiment shown in FIGS. 1–5, the button 7 is provided with an upper cylindrical projection 19 on which the side area 3 pivots by means of a corresponding hole 21 produced in the same side area 3 of the visor 20. The cylindrical projection 19, with the aid of the circular guides 4*a*, 4*b* which guarantee stable and reliable rotation of the visor 20, acts as a pin for the visor 20 and therefore the axis of the projection 19 coincides with the axis A—A around which the visor 20 rotates.

The visor 20, in line one of its side areas 3, comprises (see FIGS. 4*a*, 4*b* and 5), positioned around the hole 21, two integral hooking elements 22*a*, 22*b* provided to engage with the grooves 4*a* and 4*b* respectively, by means of insertion into the openings 5*a* and 5*b*. The hooking elements 22*a*, 22*b* are disposed in position diametrally opposite in relation to the axis of the hole 21.

In greater detail, each hooking element 22*a*, 22*b*, is "C" shaped and has a rear surface 28, perpendicular to the visor 20, joined to a lower surface 27 which in turn is joined by means of an inclined surface 26 to a surface 24 substantially parallel to the visor 20 and suitable to slide along the lower surface of the rim 13*a* or 13*b* of the groove 4*a* or 4*b*. The surface 24 terminates, corresponding to the closed end of the cavity of the "C" shaped hooking element, with another orthogonal surface 25 designed to come into contact with the supporting and retaining rim 13*a* or 13*b*. The walls 24, 25 and the internal surface of the side area 3 of the visor 20 define the "C"-shaped cavity of each hooking element 22*a*, 22*b*.

The presence and shape of the button 7, illustrated above, and the hole 21, and the hooking elements 22*a*, 22*b*, of the visor 20 make the structure of the mechanism for mounting the visor extremely simple and compact and facilitate, although preventing accidental release, removal and mounting of the visor 20. In fact, the button 7, acting as a pin for the visor 20 and as an operating means for the locking tab 6, with reduced travel along the axis of rotation A—A of the visor 20, allows the dimensions of the mechanism to be limited and can also be operated easily by the user thanks to the hole 21, even if this operation does not release the visor 20 directly.

The dimensions of the surface 24 and the distance between the surfaces 25 and 28 are also designed to allow engagement with the groove 4*a* or 4*b* of the base structure 1 of the mechanism to mount the visor 20, so that the hooking element 22*a* or 22*b* can only slide along the trajectory defined by the rim 13*a*, 13*b* of the groove 4*a*, 4*b*, and simultaneously it may be set apart from the rim 13*a*, 13*b* and made to run in the direction of the axis of rotation A—A only through the opening 5*a*, 5*b* of the groove 4*a*, 4*b*.

Moreover, in particular, the distance between the walls 25 and 28 and the dimensions of the locking tab 6 are such that when the surface 25 of each hooking element 22*a*, 22*b* rests against the respective rim 13*a*, 13*b* of the guide groove 4*a*, 4*b*, the locking tab 6 can, thrust by the spring 8, position itself in its position to intercept the opening 5*a* of the groove 4*a*, even if the hooking element 22*a* is disposed corresponding to this opening 5*a*.

The side area 3 also comprises one or more teeth 23 suitable to engage with one or more corresponding teeth 15 on a side surface of the base support 1. Engagement of the teeth 23 of the visor with the teeth 15 of the base structure 1 makes it possible to rotate the visor 20 in relation to the eyeport opening 12 only according to fixed angular increases and therefore only for the eyeport opening 12 positions established by the helmet manufacturer.

The distance between the axis of the cylindrical seat 9 of the base structure 1 and each opening 5*a*, 5*b* of the guide groove 4*a*, 4*b* is such that the hooking elements 22*a*, 22*b* of the side area 3 of the visor 20 can engage inside these openings 5*a*, 5*b* without the upper cylindrical projection 19 of the button 7 simultaneously engaging inside the hole 21 of the visor 20. Therefore, insertion of the hooking elements 22*a*, 22*b* of the side area 3 of the visor 20 inside the guide grooves 4*a* and 4*b* and engagement of the cylindrical projection 19 with the hole 2 requires, as will be described in greater detail below, first insertion of the elements 22*a*, 22*b* inside the respective openings 5*a*, 5*b*, by translation along a direction parallel to or coinciding with the axis A—A of rotation, and then translation of the visor 20, in a direction orthogonal to the axis A—A, to allow engagement of the hooking elements 22*a*, 22*b* with the rims 13*a*, 13*b* of the grooves 4*a*, 4*b* and simultaneously insertion of the projection 19 inside the hole 21.

This geometrical layout of the parts necessarily requires the exertion of two consecutive forces aimed orthogonally in relation to each other to obtain insertion, and hence also removal, of the hooking elements 22*a*, 22*b* of the visor 20 in the grooves 4*a*, 4*b* of the base 1 by the user, making any accidental release of the visor impossible.

The base structure 1 is also fixed to the cap 3 of the helmet in an angular position so that the hooking elements 22*a*, 22*b* of the visor 20 meet the widened portions 14*a*, 14*b* of the grooves 4*a*, 4*b* and therefore the openings 5*a*, 5*b*, only when the visor is fully raised, that is when the visor leaves the eyeport opening 12 of the helmet completely uncovered. This guarantees removal of the visor 20 only when the visor 20 is not in use and therefore, presumably, when the user is not moving.

Mounting of the side area 3 of a visor 20 in a mechanism of the type described above and therefore operation of this mechanism, with reference to the FIGS. 6*a*, and 6*b*, is obtained by first positioning the hooking elements 22*a*, 22*b* corresponding to the openings 5*a*, 5*b* of the guide grooves 4*a*, 4*b*, so that the rear surface 28 of each hooking element 22*a*, 22*b* is positioned substantially corresponding to the widened sliding portions 14*a*, 14*b* of the wall of the opening 5*a*, 5*b* and the lower wall 27 of the hooking element 22*a* is resting on the upper surface of the locking tab 6. As mentioned above, the latter is thrust by the spring 8, by means of the button 7, to occlude the opening 5*a* of the groove 4*a*.

By then exerting pressure on the side area 3 of the visor 20, in the same direction as the axis of rotation A—A of the visor 20 and with sufficient modulus to overcome the force exerted by the spring 8, the locking tab 6 translates along a direction parallel to the axis A—A to reach the position in which it disengages from the opening 5*a*, to consequently allow the hooking element 22*a* to be inserted in the groove 4*a*. The other hooking element 22*b* finds nothing to prevent it from passing through the corresponding opening 5*b*, as the latter is not occluded by any temporarily locking tab. This situation is shown in FIG. 6*a*.

The thrust on the side area 3 of the visor 20 have to be stopped only when the cavity defined by the walls 24 and 25 of each hooking element 22*a*, 22*b* is in line with the rim 13*a*, 13*b* of the relative guide groove 4*a*, 4*b*. At this point a further thrust is required on the side area 3 of the visor 20 directed according to the line that joins the two hooking elements 22*a*, 22*b*, that is in a direction substantially orthogonal to the axis A—A, to allow engagement of the cavity of each hooking element 22*a*, 22*b* with the rim 13*a*, 13*b* of the relative groove 4*a*, 4*b*. In particular, with reference for clarity to only one hooking element 22*a*, by thrusting the side area 3 in this direction orthogonal to the axis A—A the surface 24 of the hooking element 22*a* slides on the lower surface of the supporting and retaining rim 13*a* of the groove 4*a*, until the surface 25 is resting against the rim 13*a*, coupling with this.

This sliding of the hooking element 22*a* in a direction transverse to the axis A—A frees the opening 5*a* and allows the locking tab 6, thrust by the spring 8 and no longer obstructed by the surface 27, to return to the position in which it occludes the opening 5*a*. In this layout, represented in FIG. 6*b*, the locking tab 6 prevents any sliding of the hooking element 22*a*, and therefore of the visor 20, transverse to the axis A—A, when this hooking element 22*a* is in line with the opening 5*a*. Engagement of the cavity of the hooking elements 22*a*, 22*b* with the supporting and retaining rims 13*a*, 13*b* of the grooves 4*a*, 4*b*, moreover, prevents any sliding of these hooking elements 22*a*, 22*b* in a direction parallel to the axis A—A, which are thus obliged to slide only along the trajectory defined by the guide grooves 4*a*, 4*b*.

Simultaneously to engagement of the hooking elements 22*a*, 22*b* in the guide grooves 4*a*, 4*b*, the geometry of the mechanism allows engagement of the cylindrical projection 19 of the button 7 inside the hole 21 of the side area 3 of the visor 20. In this way, the button 7 is always accessible to the user and the visor 20 is appropriately pivoted on this projection 19 to rotate around the axis A—A.

To remove the side area 3 of the visor 20 from the base structure 1, performing the operations described above in reverse order, it is therefore necessary to position the visor so that the hooking elements 22*a*, 22*b* are in line with the openings 5*a*, 5*b* and pressure must then be applied to the button 7, in the direction of the axis A—A and with sufficient modulus to overcome the resistance of the spring 8, suitable to cause movement of the locking tab 6 along an axis parallel to the axis A—A, in its position disengaged from the opening 5*a*.

Having set free the opening 5*a*, the side area 3 of the visor 20 must then be translated in a direction substantially orthogonal to the axis A—A, allowing release of the hooking elements 22*a*, 22*b* from the respective supporting and retaining rims 13*a*, 13*b* of the grooves 4*a*, 4*b* and to position them in line with the openings 5*a*, 5*b*. By then releasing the button 7, the force exerted by the spring 8 by means of the locking tab 6 causes translation, in a direction parallel to the axis A—A, of the hooking element 22*a* and the element 22*a* is thus disengaged from the guide groove 4*a*. Further translation of the element 22*b* in a direction parallel to the axis A—A releases the side area 3 of the visor 20 from the base structure 1 of the mechanism according to the present invention.

From the above, the great simplicity of the mechanism according to the present invention as described above and its simultaneous total safety against accidental releases are evident. The need, for the user, to position the visor in a specific angular position, corresponding to the fully open position of the eyeport opening 12, and to exert two consecutive forces in orthogonal directions to each other, makes accidental unhook of the visor 20 almost impossible.

The simplicity of operation of the mechanism described is not however attained to the detriment of structural simplification of the mechanism and its easy assembly.

In fact, the mechanism shown in FIGS. 1–5 and 6*a*, 6*b* is composed of only six parts, also considering the two bolts 11*a*, 11*b*, and its assembly consists of the following simple phases:

positioning the spring 8 in the cylindrical seat 9 of the base structure 1;

fitting the locking tab 6 into the side window 10;

pressing the button 7, to tension the spring 8, so that its side projection 18, becoming elastically deformed, goes beyond the upper rim of the seat 9 and is inserted, returning to its undeformed layout, inside the axial housing 16 provided on the side surface of the seat 9;

fastening the base structure 1, equipped with the spring 8 and the button 7 inside the cylindrical seat 9, to the cap 2 of the helmet by means of bolts 11*a*, 11*b;* fitting the visor to the base structure 1 as described above.

FIG. 7 represents a further embodiment of the mechanism according to the present invention, comprising a base structure 101 which has, analogously to the structure 1 in FIG. 1, two circular guide grooves 104*a*, 104*b*, equipped with widened portions which form the openings 105*a*, 105*b* for corresponding hooking elements integral with the visor (not shown) and a cylindrical seat 109.

Housed in the cylindrical seat 109 is a button 107, mounted elastically thanks to a spring 108, which has a side projection 106 designed to act as a locking tab in an opening 105*a* of a guide groove 104*a*. The locking tab 106 is made to translate, along an axis parallel to the axis of rotation of the visor, between a position to intercept the opening 105*a* and position to disengage from it. The button 107 is also equipped with an upper projection 119 on which the side area of the visor pivots by means of a hole produced in this side area. The base structure 101 also has two through slots 117*a*, 117*b*, elongated, which are used to fix the structure 101 to the cap of the helmet and, on the external edge, toothed zones 131*a* and 131*b* in a position diametrally opposite and parallel to each other.

Unlike the embodiment shown in FIGS. 1–5, the structure 101 comprises an elastic tooth 115, such as a band spring with a protuberance, made to engage in a rack produced correspondingly on the visor. Coupling of the elastic tooth 115 with the rack of the visor (for example, as indicated with 23 in FIGS. 4*a*, 4*b* extended for an arc of greater length and coinciding with the angle described by the visor during aperture) allows rotation of the visor in relation to the eyeport opening by pre-defined angular increases.

Moreover, the mechanism described also comprises an auxiliary plate 29, with toothed raised areas 130*a* and 130*b* on the external rim suitable to couple with the toothed areas 131*a* and 131*b* present on the base 101 which, interposed between the base structure 101 and the cap of the helmet, has the function of allowing accurate adjustment of the structure 101 and therefore of the visor coupled to it subsequently in relation to the cap of the helmet.

Thanks to holes with hexagonal recesses 30*a*, 30*b*, the auxiliary plate 29 is in fact fixed to the cap of the helmet by means of inserts with perforated hexagonal heads with double thread, internal and external (not shown), clamped internally to the cap with nuts.

After fixing the plate 29 to the cap, the base 101 is disposed on the plate taking care to align the raised areas 130*a* and 130*b* with the toothed areas 131*a* and 131*b* and subsequently the threaded elements 11*a* and 11*b* are inserted into the internally threaded inserts of the plate 29. The teeth allow the base 101 to translate, according to pre-established positions, in relation to the auxiliary plate 29 and thus adjustment of the distance of the visor from the cap, thus allowing adjustment of the seal of any sealing elements (not shown) interposed between them.

What is claimed is:

1. Mechanism to removably anchor a side area of a visor to the cap of a helmet so that the visor rotates in relation to the eyeport opening of the helmet, of the type comprising:

a base structure, anchored to the cap, and provided with at least one circular guide groove substantially orthogonal to the axis of rotation (A—A) of the visor and which has at least one widened portion defining an opening;

at least one hooking element integral with said side area of the visor and suitable to engage slidingly inside the aforesaid circular groove, the hooking element being held in place by the circular guide groove except when corresponding to the opening defined by said widened portion;

the mechanism also being characterized in that it comprises at least one locking tab positioned substantially in correspondence to said at least one widened portion and made to translate, along an axis coinciding with or substantially parallel to the axis of rotation (A—A) of the visor, between a position in which said locking tab intercepts said at least one widened portion, reducing the opening, and a position in which said locking tab is disengaged from said at least one widened portion, freeing the opening.

2. Mechanism as claimed in claim 1, in which said base structure comprises a cylindrical seat and characterized in that it comprises a button mounted elastically inside said cylindrical seat and connected to said at least one locking tab, said button being anchored to translate along the axis of said cylindrical seat to allow translation of said locking tab.

3. Mechanism as claimed in claim 2, characterized in that it comprises one or more springs, interposed between said button and the base of said cylindrical seat for elastic mounting of the button.

4. Mechanism as claimed in claim 3, in which said one or more springs hold the button in a position in which said locking tab is pushed in said position to intercept said at least one widened portion.

5. Mechanism as claimed in claim 2, characterized in that said button comprises an elastically deformable projection which engages in an axial housing, obtained in the internal side wall of the cylindrical seat, for translation along the axis of said cylindrical seat of the button.

6. Mechanism as claimed in claim 2, characterized in that the axis of said cylindrical seat coincides with or is parallel to the axis (A—A) around which the visor rotates and said locking tab is integral with the button.

7. Mechanism as claimed in claim 2, characterized in that said button comprises an upper cylindrical projection on which said side area pivots by means of a corresponding hole produced on said side area of the visor.

8. Mechanism as claimed in claim 7, characterized in that the opening defined by said at least one widened portion of the guide groove is set apart from the axis of said upper cylindrical projection of the button to allow said hooking element to be inserted in the guide groove and to prevent simultaneous coupling of the upper projection of the button with said hole on the side area of the visor.

9. Mechanism as claimed in claim 2, characterized in that said locking tab is inserted in a through hole produced on a side wall of said cylindrical seat.

10. Mechanism as claimed in claim 1, characterized in that said at least one hooking element is anchored by said at least one guide groove to slide along the trajectory defined by said at least one groove, except when corresponding to said at least one widened portion, in which said at least one hooking element may translate in a direction substantially orthogonal to the axis of rotation of the visor to disengage from said guide groove.

11. Mechanism as claimed in claim 1, characterized in that said at least one widened portion of the groove is disposed so that said at least one hooking element integral with the visor is positioned corresponding to the opening defined by said widened portion only when the visor is in its fully open position in relation to the eyeport opening of the helmet.

12. Mechanism as claimed in claim 1, characterized in that it comprises two circular guide grooves, reciprocally opposite in relation to the axis of rotation of the visor, each of which has at least one widened portion defining an opening for two respective hooking elements integral with said side area of the visor.

13. Mechanism as claimed in claim 1, characterized in that said base structure comprises through holes for the insertion of threaded fixing elements.

14. Mechanism as claimed in claim 13, characterized in that said through holes in the base structure are elongated slots and the mechanism also comprises an auxiliary plate interposed between said base structure and said cap.

15. Mechanism as claimed in claim 14, characterized in that said base structure comprises one or more toothed zones suitable to couple with one or more respective toothings integral with said auxiliary plate to regulate the distance of the visor from the cap.

16. Mechanism as claimed in claim 1, in which said at least one hooking element is concave "C" shaped and said at least one guide groove has a supporting and retaining rim against which the end surface of the concavity of said at least one "C" shaped hooking element engages slidingly.

17. Mechanism as claimed in claim 16, in which when the end surface of the concavity of said at least one "C" shaped hooking element is engaged with said supporting rim, said locking tab can occupy said position to intercept the opening.

18. Mechanism as claimed in claim 1, characterized in that said base structure comprises one or more teeth to engage with one or more teeth integral with said side area of the visor.

19. Helmet for use in motorcycling characterized in that it is provided with a pair of mechanisms as claimed in claim 1.

* * * * *